US009642776B2

(12) United States Patent
Wong et al.

(10) Patent No.: US 9,642,776 B2
(45) Date of Patent: May 9, 2017

(54) COMPOUNDING DISPENSING GUN

(71) Applicant: Medisca Pharmaceutique, Inc., Saint-Laurent (CA)

(72) Inventors: Sarah Nyat Peng Wong, Montreal (CA); Dajun Yuan, San Diego, CA (US); Wenxiong Li, San Diego, CA (US)

(73) Assignee: Medisca Pharmaceutique, Inc., Saint-Laurent (CA)

( * ) Notice: Subject to any disclaimer, the term of this patent is extended or adjusted under 35 U.S.C. 154(b) by 0 days.

(21) Appl. No.: 14/856,591

(22) Filed: Sep. 17, 2015

(65) Prior Publication Data

US 2016/0074282 A1 Mar. 17, 2016

Related U.S. Application Data

(60) Provisional application No. 62/051,433, filed on Sep. 17, 2014.

(51) Int. Cl.

| | |
|---|---|
| ***B67D 7/60*** | (2010.01) |
| ***A61J 1/22*** | (2006.01) |
| ***B05C 17/01*** | (2006.01) |

(52) U.S. Cl.

CPC ..... *A61J 1/22* (2013.01); *B05C 17/0123* (2013.01)

(58) Field of Classification Search

CPC ..... A61J 1/22; B05C 17/0123
USPC ..... 222/391, 325–327
See application file for complete search history.

(56) References Cited

U.S. PATENT DOCUMENTS

| | | | | |
|---|---|---|---|---|
| 2,115,591 | A * | 4/1938 | Sherbondy | B05C 17/0123 222/327 |
| 2,889,085 | A * | 6/1959 | Collins | B05C 17/0123 222/391 |
| 4,425,121 | A * | 1/1984 | Young | A61D 7/00 604/209 |
| 5,501,374 | A * | 3/1996 | Laufer | B05C 17/0123 222/391 |
| 6,386,401 | B1 * | 5/2002 | Dodd | B05C 17/01 222/391 |
| 6,672,489 | B1 * | 1/2004 | Huang | G01F 11/026 222/391 |
| 8,857,673 | B2 * | 10/2014 | Szpak | B65D 83/0033 222/326 |
| 2013/0161360 | A1 * | 6/2013 | Marsden | B65D 83/0033 222/391 |

* cited by examiner

*Primary Examiner* — Lien Ngo
(74) *Attorney, Agent, or Firm* — Ward Law Office LLC; Jacob M. Ward

(57) ABSTRACT

A compounding dispensing gun includes a pawl-spring assembly and a hand-housing assembly. The hand-housing assembly is coupled to the pawl-spring assembly. The hand-housing assembly has a handle. A plunger assembly extends through the hand-housing assembly and includes a push rod and a push rod head removably coupled to the push rod. The push rod has a plurality of first notches and a plurality of second notches formed thereon. The push rod selectively cooperates with the pawl-spring assembly to advance the push rod and the push rod head during a dispensing operation.

18 Claims, 5 Drawing Sheets

COMPOUNDING DISPENSING GUN

CROSS-REFERENCE TO RELATED APPLICATIONS

This application claims the benefit of U.S. Provisional Application No. 62/051,433, filed on Sep. 17, 2014. The entire disclosure of the above application is hereby incorporated herein by reference.

FIELD

The disclosure generally relates to pharmaceutical compounding and, in particular, systems for dispensing compounded pharmaceutical formulations.

BACKGROUND

A known method for compounding a pharmaceutical formulation involves mixing the formulation in a compounding vessel such as an EMP jar, as a non-limiting example. A suitable EMP jar is commercially available and manufactured by GAKO® International GmbH in Munich, Germany. The EMP jar is cylindrical and has a movable piston bottom that requires a manual, physical force applied coaxially to dispense contents through a nozzle at a top of the EMP jar.

Due to the dimensions of the EMP jars, it can be difficult to push the movable piston bottom to dispense material completely or in a controlled manner. It is also known that these issues are exacerbated in EMP jars of volumes of 200 mL and larger, due to the greater surface area of the piston.

Several methods to actuating the moveable piston bottom of a compounding vessel are known, and can be selected depending on the volume size of the EMP jar. For 200 mL EMP jars, an applicator tip is typically provided, and doubles as a manual push rod and an applicator. However, this is problematic as the applicator tip can only be used as either the manual push rod or the applicator during a dispensing operation of the EMP jar.

For EMP jars having volumes of 300 mL to 1000 mL, an attachable spindle or a pneumatic pump can be attached to the bottom of the EMP jar. The spindle has some disadvantages in that it can perforate the piston bottom, introducing plastic particulates into the formulation contained by the EMP jar. The spindle is also not intuitive, in terms of utilization, and is prone to malfunction due to misalignment of threads.

The pneumatic pump requires introducing air below the piston bottom via a pump ball that is used by hand. This method can be inefficient in dispensing large dosages and does not allow for reliable control. In addition, the pneumatic pump can be difficult to use in any orientation other than when the pneumatic pump is vertically upright. This may be impractical, as dispensing the formulation often requires that the EMP jar be tilted at an angle relative to the vertical.

Another dispensing mechanism available for the EMP jars is the Topi-Click® Filling Station, manufactured by Custom RX TDA, LLC in Woodstock, Ga., USA. This mechanism provides better control of dispensing the formulation through manual force via a plunger that pushes downward on the movable piston bottom while holding the EMP jar upside-down. However, the Topi-Click® Filling Station is not portable, i.e., it is a large, bench top unit that is not hand-held and does not dispense metered amounts. Furthermore, larger EMP jar sizes need to have a custom hole cut in the piston bottom to accommodate the plunger diameter of the Topi-Click® Filling Station. Considering that the Topi-Click® Filling Station is run manually, without any automated assistance, it may not be a cost-efficient solution for many compounding pharmacists.

There is a continuing need for a cost-efficient system that permits an easy and ergonomically efficient dispensing of pharmaceutical compounds from varying sizes and types of compounding vessels. Desirably, the system also allows the pharmaceutical compounds to be dispensed in a controlled, metered, and decontaminated manner.

SUMMARY

In concordance with the instant disclosure, a system that permits an easy and ergonomically efficient dispensing of pharmaceutical compounds from varying sizes and types of vessels, and which also allows the pharmaceutical compounds to be dispensed in a controlled, metered, and decontaminated manner, has surprisingly been discovered.

In one embodiment, a dispensing gun includes a pawl-spring assembly. A hand-housing assembly is coupled to the pawl-spring assembly. The hand-housing assembly has a handle. A plunger assembly extends through the hand-housing assembly. The plunger-assembly includes a push rod. A push rod head is removably coupled to the push rod. The push rod has a plurality of first notches and a plurality of second notches formed thereon. The push rod selectively cooperates with the pawl-spring assembly to advance the push rod and the push rod head during a dispensing operation.

In another embodiment, a dispensing gun includes a pawl-spring assembly with a hand-housing assembly coupled thereto. The hand-housing assembly has a handle. A plunger assembly extends through the hand-housing assembly and includes a push rod with a push rod head removably coupled thereto. The push rod has a plurality of first notches formed thereon. The push rod selectively cooperates with the pawl-spring assembly to advance the push rod and the push rod head during a dispensing operation. An interchangeable cradle is removably coupled to the hand-housing assembly. The interchangeable cradle is configured to receive a vessel.

In yet another embodiment, a method for dispensing a material from a vessel includes the step of providing a dispensing gun having a pawl-spring assembly coupled to a hand-housing assembly. The method also includes the step of extending a plunger assembly through the hand-housing assembly. The plunger assembly has a push rod and a push rod head removably coupled to the push rod. The push rod has a plurality of first notches, a plurality of second notches, and a smooth section formed thereon. The method additionally includes the steps of selecting a cradle configured to receive the vessel, coupling the cradle to the hand-housing assembly, and positioning the vessel within the cradle. The vessel has a moveable piston bottom. The push rod is rotated to position one of the plurality of first notches, the plurality of second notches, and the smooth section in communication with the pawl-spring assembly. The method further includes the step of advancing the push rod to engage the push rod head with the moveable piston bottom of the vessel and to dispense a desired dosage of the material from the vessel.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
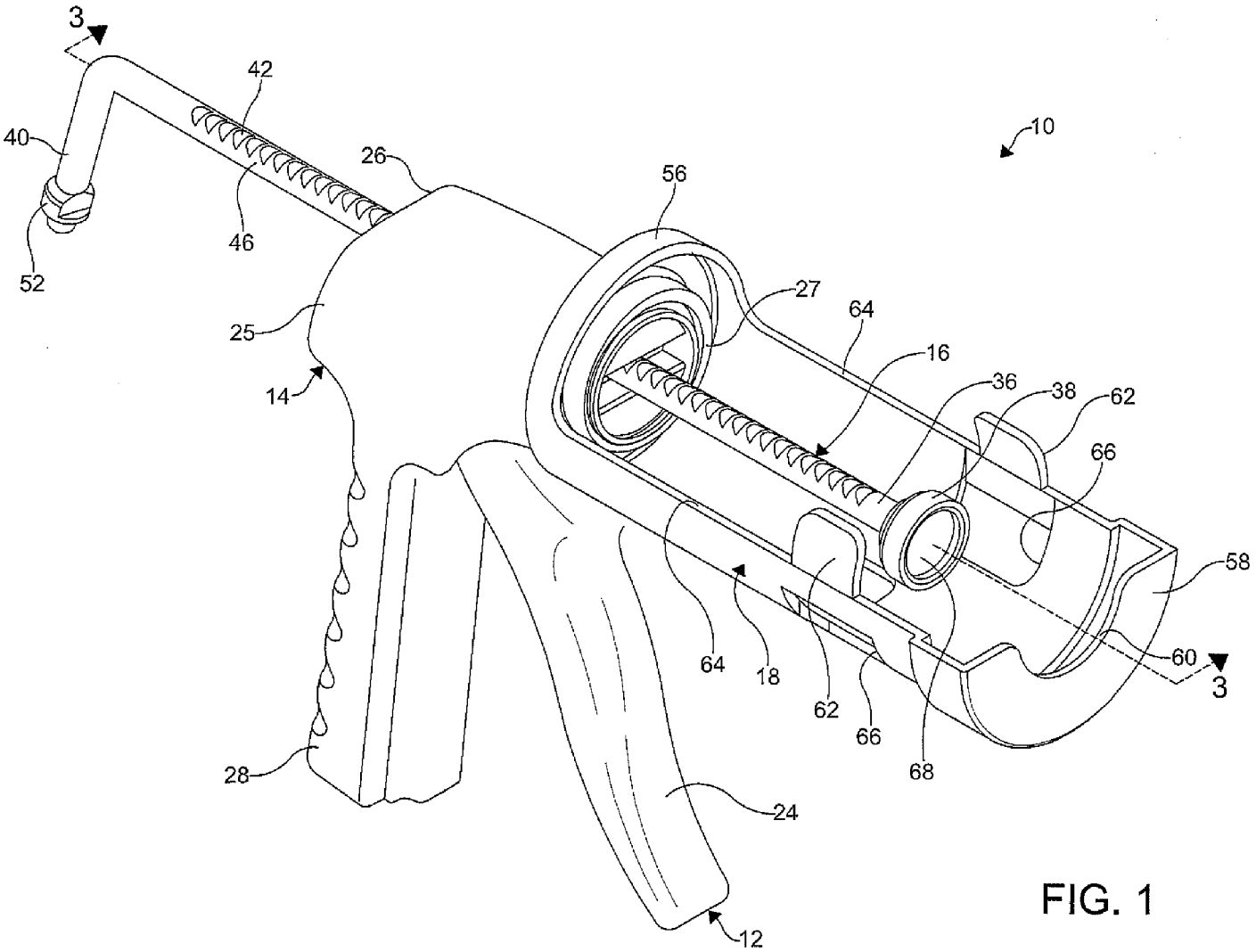
FIG. 1 is a front right perspective view of a dispensing gun according to an embodiment of the disclosure, shown without a compounding vessel.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Figure 2:
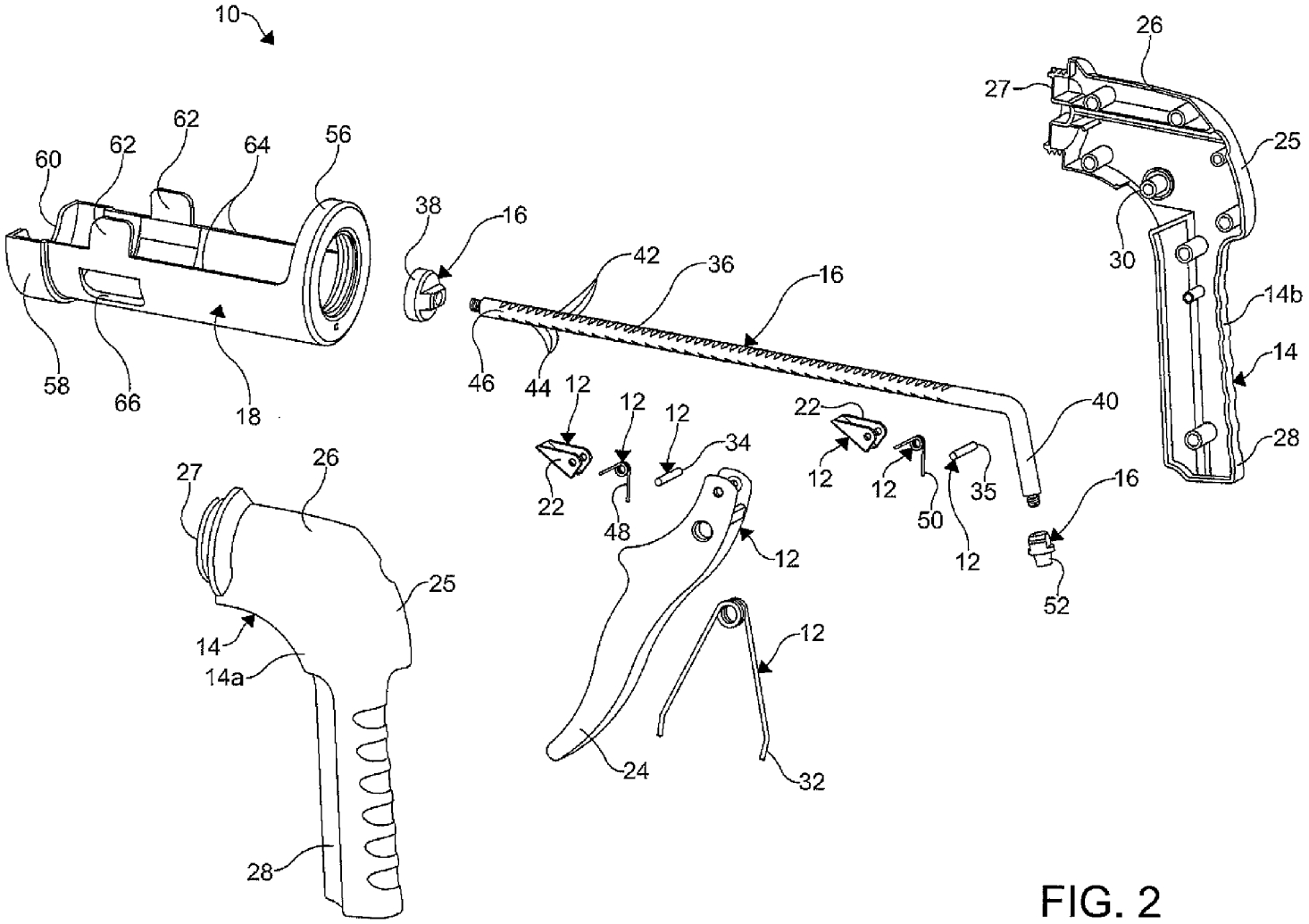
FIG. 2 is an exploded left rear perspective view of the dispensing gun shown in FIG. 1.
Figure 3:
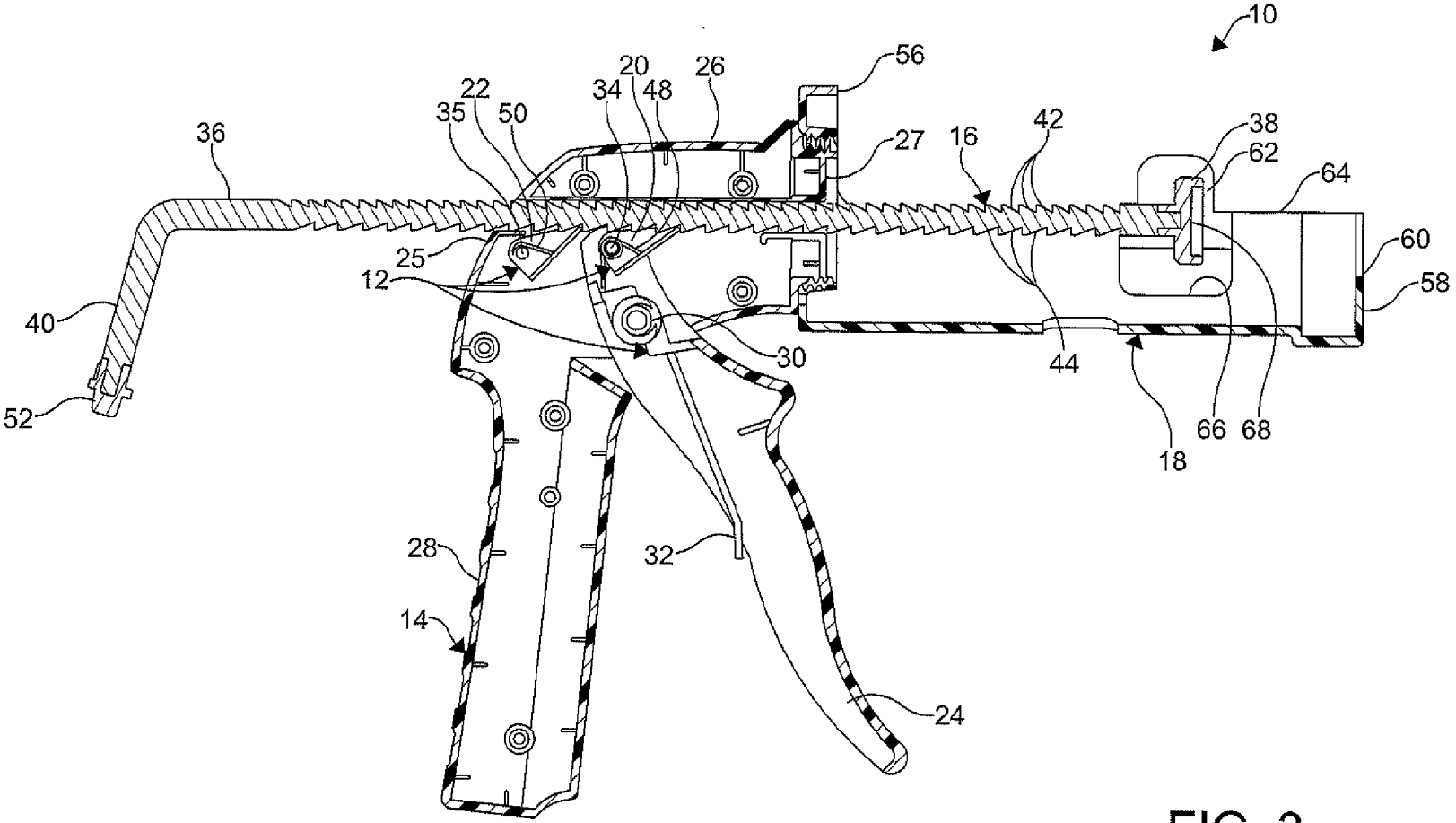
FIG. 3 is a cross-sectional right side elevational view of the dispensing gun, taken along the section line 3-3 in FIG. 1.
Figure 4:
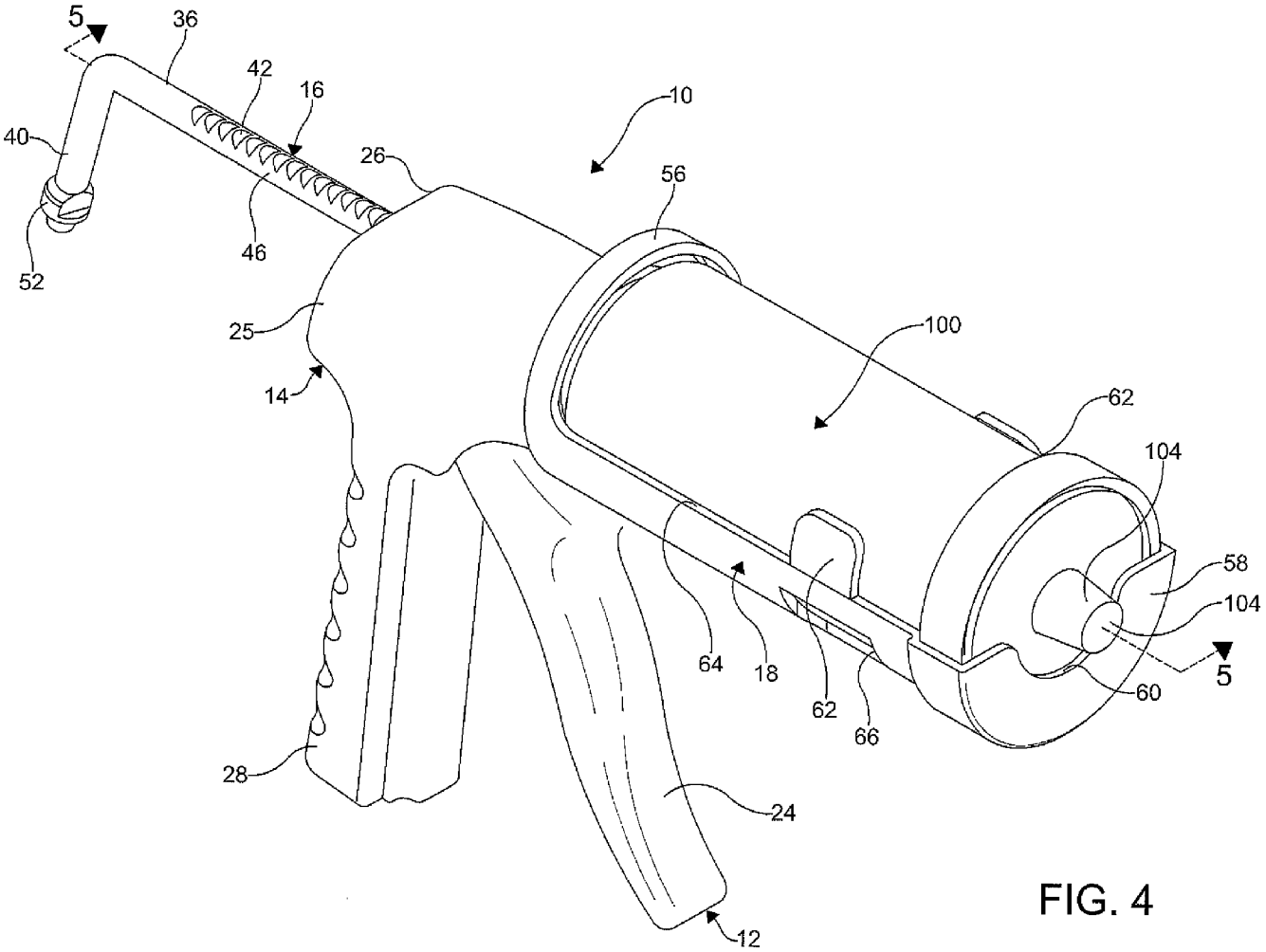
FIG. 4 is a front right perspective view of the dispensing gun of FIG. 1, shown with a compounding vessel.
Figure 5:
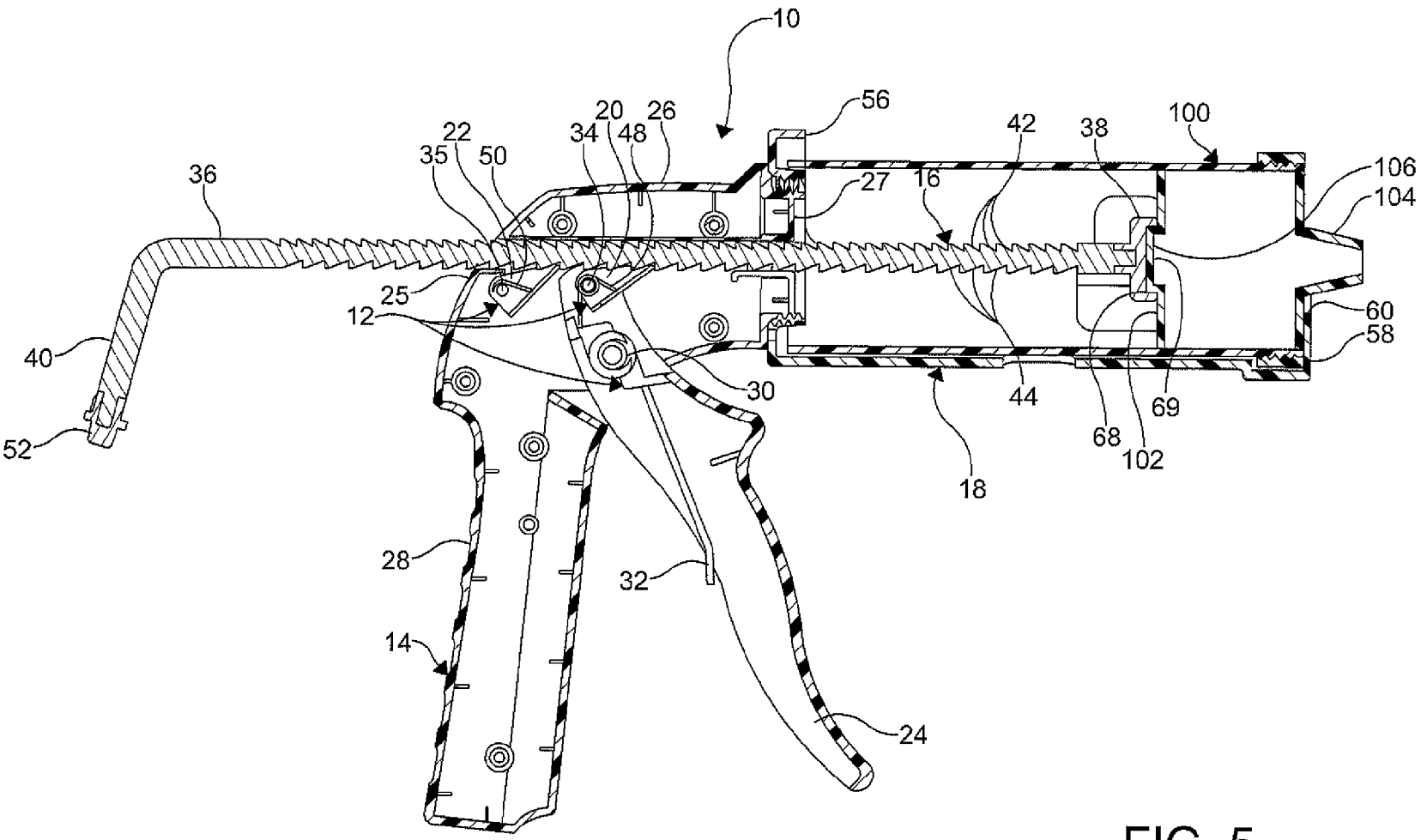
FIG. 5 is a cross-sectional right side elevational view of the dispensing gun and the compounding vessel, taken along the section line 5-5 in FIG. 4.

FIGS. 1-5 illustrate a dispensing gun 10 for facilitating a dispensing of a material from a compounding vessel 100, according to one embodiment of the present disclosure. For purposes of clarity, FIGS. 1-3 illustrate the dispensing gun 10 without the compounding vessel 100, and FIGS. 4-5 illustrate the dispensing gun 10 with the compounding vessel 100. The material to be dispensed may include any liquid or semi-liquid material with the consistency of a cream, a gel, a lotion, an ointment, etc., either compounded or non-compounded. Additionally, although one type of known compounding vessel 100 described hereinabove is an EMP jar, it should be understood that any suitable compounding vessel may be employed or used within the scope of the present disclosure.

As shown in FIGS. 1-3, the dispensing gun 10 has a pawl-spring assembly 12, a hand-housing assembly 14, a plunger assembly 16, and a removable cradle 18 cooperating with each other to dispense a desired dosage of the compounding material from the compounding vessel 100. Advantageously, the dispensing gun 10 has both a metered mode and a non-metered mode, which are described in greater detail further herein.

The pawl-spring assembly 12 includes a first pawl 20, a second pawl 22 and a lever 24. The hand-housing assembly 14 is coupled to the pawl-spring assembly 12 and includes an upper portion 26 and a handle 28 depending from the upper portion 26. The handle 28 can include surface features configured to facilitate gripping.

In the exemplary embodiment illustrated in FIG. 2, the hand-housing assembly 14 is formed from a pair of molded hand-housing sub-components 14*a*, 14*b* to facilitate ease of assembly. In certain embodiments, the sub-components 14*a*, 14*b* matingly engage with each other by locating-and-locking features integrally formed with the hand-housing sub components 14*a*, 14*b*. The locating-and-locking features can include bosses and corresponding inserts. In other embodiments, the sub-components 14*a*, 14*b* can be coupled to each other by separate fastening means such as screws, threaded inserts, pins, bolts, rivets, adhesives, bonding, welding, or any other suitable fastening means, as desired. However, it is understood the hand-housing assembly 14 can be integrally formed as a unitary unit or formed from any number of components, as desired.

With continued reference to FIGS. 1-3, the upper portion 26 of the hand-housing assembly 14 houses the first pawl 20, the second pawl 22, and a portion of the lever 24. The lever 24 is pivotally coupled to the upper portion 26 by a pivot 30 and is biased outwardly from the handle 28 by a torsion spring 32. The first pawl 20 is pivotally coupled to the lever 24 by a pin 34. The second pawl 22 is pivotally coupled to the upper housing 26 by a pin 35 and positioned intermediate the first pawl 20 and a rear end 25 of the upper portion 26 of the hand-housing assembly 14.

The plunger assembly 16 includes a push rod 36, a push rod head 38 disposed at a first end of the push rod 36, and a retractor handle 40 disposed at a second end of the push rod 36. The push rod 36 extends longitudinally through the upper portion 26 of the hand-housing assembly 14 through a hole formed in the rear end 25 of the upper portion 26 and through a threaded opening formed in a front end 27 of the upper portion 26. When extended through the upper portion 26, the first end of the push rod 36 extends outwardly from the front end 27 of the upper portion 26 and the second end of the push rod 36 extends outwardly from the rear end 25 of the upper portion 26.

The push rod 36 includes a plurality of first notches 42 extending along a length of the push rod 36 and a plurality of second notches 44 extending along a length of the push rod 36. The first notches 42 are formed on a first side of the push rod 36 and the second notches 44 are formed on a second side of the push rod 36 diametrically opposing the first side. Each of the first notches 42 and the second notches 44 have a slanted pitch. While not shown in the embodiment illustrated in FIGS. 1-3, the push rod 36 can include a plurality of third notches or fourth notches, if desired. A substantially smooth or toothless section 46 is formed between the first notches 42 and the second notches 44.

Each of the first notches 42 are equally spaced apart from adjacent ones of the first notches 42 and each of the second notches 44 are equally spaced apart from adjacent ones of the second notches 44. The distance between adjacent ones of the first notches 42 is different from the distance between adjacent ones of the second notches 44. The distances between the adjacent ones of the first notches 42 and the distances between the adjacent ones of the second notches 44 are configured to correspond to a desired dispensing dosage. For example, the distance between the adjacent ones of the first notches 42 can correspond to a 10 mL dispensing dosage and the distance between the adjacent ones of the second notches 44 can correspond to a 15 mL dispensing dosage. Accordingly, a distance between every other one of the first notches 42 corresponds to a 20 mL dispensing dosage and a distance between every other one of the second notches 44 corresponds to a 30 mL dispensing dosage. However, any distance corresponding to any desired dispensing dosage can be contemplated, as desired.

The first pawl 20 and the second pawl 22 are biased by springs 48, 50 towards the push rod 36. The push rod 36 is rotatable within the upper portion 26 of the hand-housing assembly 14 to position the first pawl 20 and the second pawl 22 to selectively engage with the first notches 42, the second notches 44, or the smooth section 46 of the push rod 36 depending on the desired dispensing dosage. The retractor handle 40 facilitates the rotation of the push rod 36.

In one embodiment, the push rod head 38 is threadingly coupled to the push rod 36. However, the push rod head 38 can be coupled to the push rod 36 by other coupling means such as a snap-fit, an interference fit, a cam lock, or any other coupling means, as desired. In another embodiment, the push rod head 38 is permanent attached to the push rod 36, for example, being a continuous metal piece including the push rod 36 and the push rod head 38. In certain embodiments, the push rod head 38 can have a substantially disc shaped body with an outwardly extending rim forming a recess 68 therein. However, any suitable shape or configuration of the push rod head 38 can be used, as desired.

In certain embodiments, the push rod head 38 is interchangeable with a secondary push rod head 52. The secondary push rod head 52 may be stored, when not in use, by being threadingly coupled to the second end of the push rod 36.

Each of the push rod head 38 and the secondary push rod head 52 are employed for use with varying compounding vessels 100. For example, the push rod head 38 can be coupled to the first end of the push rod 36 for use with a 100 mL or a 200 mL EMP jar, and the secondary push rod head 52 can be coupled to the first end of the push rod 36 for use with a 300 mL or a 500 mL EMP jar. It is understood that varying push rod heads can be configured for varying EMP jars or other compounding vessels, as desired.

The cradle 18 is coupled to and extends longitudinally from the front end 27 of the upper portion 26 of the hand-housing assembly 14 and is configured to receive the compounding vessel 100. In one embodiment, the cradle 18 has a semi-annular cross-section. An annular receptacle 56 is formed at a first end of the cradle 18 and a semi-annular receptacle 58 is formed at a second end of the cradle 18. The annular receptacle 56 can have a threaded portion, which is configured to cooperate with the threaded opening of the upper portion 26. The threaded opening of the upper portion 26 permits a variety of different sizes and types of cradles 18 to be removably installed onto the hand-housing assembly 14, to accommodate varying types of compounding vessels. The semi-annular receptacle 58 includes a slot 60 formed therein. The push rod 36 extends from the hand-housing assembly 14 through the annular receptacle 56 and is slidable along a length of the cradle 18.

It should also be appreciated that the cradle 18 can have a different shape without the annular receptacle 56 and the semi-annular receptacle 58. Likewise, the coupling mechanism may not be threaded, and a skilled artisan may use other suitable coupling means, as desired.

The cradle 18 further includes retaining tabs 62 extending from a pair of longitudinal edges 64 of the cradle 18. The retaining tabs 62 are configured to retain the compounding vessel 100 within the cradle 18. In the embodiments illustrated, a first one of the retaining tabs 62 extends outwardly from a first one of the longitudinal edges 64 and a second one of the retaining tabs 62 extends outwardly from a second one of the longitudinal edges 64 opposite the first one of the retaining tabs 62. It is understood that just one, or more than two, of the retaining tabs 62 can extend from the longitudinal edges 64 at any position, as desired.

The cradle 18 further includes windows 66 formed therethrough. The windows 66 permit access to the compounding vessel 100 to dislodge the compounding vessel 100 from the cradle 18. In the embodiment illustrated, the cradle 18 includes two windows 66 adjacent and aligned with the retaining tabs 62. However, it is understood the cradle 18 can include any numbers of windows 66, as desired. Different shapes and numbers of retaining tabs 62 and the windows 66 are also contemplated, and considered to be within the scope of the present disclosure.

In FIGS. 4-5, the dispensing gun 10 includes the compounding vessel 100 received within the cradle 18. As one non-limiting example, the compounding vessel 100 is an EMP jar configured to store a compounding material. The EMP jar is commercially available and manufactured by GAKO® International GmbH in Munich, Germany. Although, other compounding vessels are contemplated and may be used.

The compounding material can be any predetermined or customized pharmaceutical formulation that has been triturated, levigated, mixed, milled, or otherwise prepared by a pharmacist, for example. However, the compounding material can be any other liquids or semi-liquid materials, such as creams, gels, lotions, ointments without departing from the scope of the invention.

The compounding vessel 100 is cylindrical and has a movable piston bottom 102 that requires a manual, physical force applied coaxially to dispense contents through a nozzle 104 at a top of the compounding vessel 100. For example, the compounding vessel 100 can be configured as a 100 mL, 200 mL, 300 mL, 400 mL, 500 mL EMP jar, or any other size EMP jar as desired. However, the compounding vessel 100 can be configured as any jar, container, or vessel with the piston bottom 102, as desired.

As shown in FIGS. 4-5, the nozzle 104 of the compounding vessel 100 is received by the slot 60. The top of the compounding vessel 100 is received in the semi-annular receptacle 58. The push rod head 38 coaxially engages the piston bottom 102 of the compounding vessel 100. In the exemplary embodiment illustrated in FIG. 5, the recess 68 receives a protuberance 106 commonly formed on the piston bottom 102 of the compounding vessel 100.

The lever 24 of the pawl-spring assembly 12, the hand-housing assembly 14, and the cradle 18 are formed from a durable, moldable, and light weight material such as glass filled nylon, for example. However, it is understood that the lever 24 of the pawl-spring assembly 12, the hand-housing assembly 14, and the cradle 18 can be formed from a metal, any other synthetic material such as polyethylene, polypropylene, or polyvinyl chloride or a metal, or any other durable and lightweight material, as desired.

In application, a user chooses the compounding vessel 100 desired. The cradle 18 configured for the desired compounding vessel 100 is coupled to the hand-housing assembly 14. The compounding vessel 100 is inserted into the cradle 18 so that the nozzle 104 is received in the slot 60 and the push rod head 38 engages with the piston bottom 102. The retaining tabs 62 retain the compounding vessel 100 securely in the cradle 18. The user can select to dispense the compounding material from the compounding vessel 100 by operating the dispensing gun 10 in a metered mode or a non-metered mode.

In the metered mode, the user employs the retractor handle 40 to rotate the push rod 36 to place either the first notches 42 or the second notches 44 in communication with the pawls 20, 22 of the pawl-spring assembly 12, depending on the dispensing dosage desired. For purposes of illustration, in FIGS. 4-5, the second notches 44 are shown in communication with the pawls 20, 22 of the pawl-spring assembly 12. Once the desired second notches 44 are chosen, the lever 24 of the pawl-spring assembly 12 is squeezed by hand towards the handle 28 of the hand-housing assembly 14, and pivoted about the pivot 30. Upon compression of the lever 24 towards the handle 28, the first pawl 20 is forced against a first one of the second notches 44. The force of the first pawl 20 causes the push rod 36 and the push rod head 38 to advance along the length of the cradle 18 and through the compounding vessel 100. The push rod head 38 engages with the piston bottom 102 of the compounding vessel 100 to advance the piston bottom 102 which, in turn, causes the compounding material to be dispensed from the compounding vessel 100 at the desired dosage.

Once the lever 24 is released, the first pawl 20 disengages the first one of the second notches 44 and springs into communication with an adjacent second one of the second notches 44. The second pawl 22 engages a third one of the second notches 44 to militate against rearward movement of the push rod 36. The lever 24 can be squeezed and released repeatedly to dispense the compounding material from the compounding vessel 100 at the desired dosage on a continual basis. For example, where the distance between the adjacent ones of the second notches 44 corresponds to the dispensing dosage of 15 mL, each time the lever 24 is squeezed, 15 mL of the compounding material is dispensed from the compounding vessel 100.

It should be appreciated that the dispensing gun 10 operates similarly as described above should the first notches 42 be positioned in communication with the pawls 20, 22, instead of the second notches 44. However, a different dosage of the compounding material will be dispensed with each compression of the lever 24.

In the non-metered mode, the user employs the retractor handle 40 to rotate the push rod 36 to place the smooth section 46 in communication with the pawls 20, 22 of the pawl-spring assembly 12. The smooth section 46 permits the user to manually advance the push rod 36 and the push rod head 38 along the length of the cradle 18 and through the compounding vessel 100. The push rod head 38 engages with the piston bottom 102 of the compounding vessel 100 to advance the piston bottom 102 which, in turn, causes the compounding material to be dispensed from the compounding vessel 100 manually.

To retract the push rod 36, the user employs the retractor handle 40 to rotate the push rod 36 to place the smooth section 46 in communication with the pawls 20, 22 of the pawl-spring assembly 12. The retractor handle 40 can then be employed to pull the push rod 36 and push rod head 38 linearly out of the compounding vessel 100 and away from the piston bottom 102. The compounding vessel 100 can then be removed and replaced with another compounding vessel 100.

Where the compounding vessel 100 is a different size or requires an alternate push rod head, the secondary push rod head 52 can be employed. The push rod head 38 can be interchanged with the secondary push rod head 52 by decoupling the push rod head 38 from the first end of the push rod 36 and the secondary push rod head 52 from the second end of the push rod 36. The secondary push rod head 52 can then be coupled to the first end of the push rod 36 and the push rod head 52 can be coupled to the second end of the push rod 36 for storing for later use.

Advantageously, the dispensing gun 10 of the present disclosure allows for an easy advancement of the piston bottom 102 of the compounding vessel 100 for purposes of dispensing the compounding material completely and/or in a controlled or metered manner. The dispensing gun 10 is portable, versatile, cost and time efficient, and minimizes contamination of compounding materials and/or devices. In certain examples, the dispensing gun 10 has been shown to provide an easy and controlled dispensing from compounding vessels 100 configured as EMP jars having volumes of 200 mL and larger, in stark contrast to known systems and methods.

The plunger assembly 16 with the first notches 42, the second notches 44, and the smooth section 46 allows for efficient interchanging between the metered mode and the non-metered mode. In the metered mode, the push rod 36 permits the user to selectively dispense varying metered dispensing dosages of the compounding material from the compounding vessel 100.

Additional advantages include the interchangeability of the cradle 18. The cradle 18 can be customized and configured to receive any type of compounding vessel, as desired, and easily interchanged with other cradle configurations depending on the compounding vessel and compounding application desired. This results in a cost-effective solution for users needing to dispense content from various compounding vessels in a metered, a controlled, and a convenient manner.

Furthermore, the push rod head 38 can be easily interchanged with the secondary push rod head 52 depending on the types of compounding vessel 100 employed with the dispensing gun 10. Due to the configuration of the pawl-spring assembly 12, minimal actuation forces are required to compress the lever 24 and actuate the advancement of the push rod 36. The handle 28 and the lever 24 facilitate ergonomic efficiency.

While certain representative embodiments and details have been shown for purposes of illustrating the invention, it will be apparent to those skilled in the art that various changes may be made without departing from the scope of the disclosure, which is further described in the following appended claims.

What is claimed is:

1. A dispensing gun, comprising:

a pawl-spring assembly;

a hand-housing assembly coupled to the pawl-spring assembly and having a handle;

a plunger assembly extending through the hand-housing assembly and including a push rod with a first end and a second end, and a push rod head removably coupled to the first end of the push rod, the push rod having a plurality of first notches and a plurality of second notches formed thereon, the push rod selectively cooperating with the pawl-spring assembly to advance the push rod and the push rod head during a dispensing operation;

a retractor handle disposed at the second end of the push rod, the retractor handle extending from the push rod at an angle transverse with a longitudinal axis of the push rod, the retractor handle having a free end; and a secondary push rod head removably coupled to the free end of the retractor handle, and interchangeable with the push rod head.

2. The dispensing gun of claim 1, wherein the plurality of first notches and the plurality of second notches extend along a length of the push rod, the plurality of first notches spaced apart from the plurality of second notches.

3. The dispensing gun of claim 2, wherein the plurality of first notches diametrically oppose the plurality of second notches.

4. The dispensing gun of claim 1, wherein the push rod has a substantially smooth section disposed between the plurality of first notches and the plurality of second notches.

5. The dispensing gun of claim 4, wherein the push rod is rotatable in the hand-housing assembly to selectively place one of the plurality of first notches, the plurality of second notches, and the substantially smooth section in communication with the pawl-spring assembly.

6. The dispensing gun of claim 1, wherein each of the plurality of first notches are equally spaced apart a first distance from adjacent ones of the plurality of first notches along a length of the push rod, and wherein each of the plurality of second notches are equally spaced apart a second distance from adjacent ones of the plurality of second notches along the length of the push rod, the first distance different from the second distance.

7. The dispensing gun of claim 1, wherein the pawl-spring assembly includes a first pawl and a second pawl, the first pawl selectively engaging one of the plurality of first notches and the plurality of second notches to advance the push rod and the push rod head during a dispensing operation, the second pawl engaging the one of the plurality of first notches and the plurality of second notches to retain advancement of the push rod and the push rod head during a dispensing operation.

8. The dispensing gun of claim 1, further comprising a cradle removably coupled to the hand-housing assembly and configured to receive a vessel, the push rod head engaging with the vessel during the dispensing operation.

9. The dispensing gun of claim 8, wherein the cradle includes an annular receptacle formed at a first end thereof and a semi-annular receptacle formed at a second end thereof.

10. The dispensing gun of claim 8, wherein the cradle includes a pair of windows formed thereon, for ejecting the vessel.

11. The dispensing gun of claim 9, wherein the cradle includes a pair of longitudinally extending edges and a retaining tab extending from each of the pair of longitudinally extending edges, the retaining tabs spaced apart from the second end of the cradle.

12. A dispensing gun, comprising:

a pawl-spring assembly;

a hand-housing assembly coupled to the pawl-spring assembly and having a handle;

a plunger assembly extending through the hand-housing assembly and including a push rod with a first end and a second end, and a push rod head removably coupled to the first end of the push rod, the push rod having a plurality of first notches formed thereon, the push rod selectively cooperating with the pawl-spring assembly to advance the push rod and the push rod head during a dispensing operation;

an interchangeable cradle removably coupled to the hand-housing assembly, the interchangeable cradle configured to receive a vessel;

a retractor handle disposed at the second end of the push rod, the retractor handle extending from the push rod at an angle transverse with a longitudinal axis of the push rod, the retractor handle having a free end; and a secondary push rod head removably coupled to the free end of the retractor handle, and interchangeable with the push rod head.

13. The dispensing gun of claim 12, wherein the interchangeable cradle is threadingly coupled to the hand-housing assembly.

14. The dispensing gun of claim 12, wherein the push rod has a plurality of second notches formed thereon, wherein each of the plurality of first notches and the plurality of second notches extend along a length of the push rod, the plurality of first notches spaced apart from the plurality of second notches.

15. The dispensing gun of claim 12, wherein the cradle includes an annular receptacle formed at a first end thereof and a semi-annular receptacle formed at a second end thereof, and wherein the cradle includes a pair of longitudinally extending edges and a retaining tab extending from each of the pair of longitudinally extending edges, the retaining tabs spaced apart from the second end of the cradle.

16. A method for dispensing a material from a vessel comprising the steps of:

providing a dispensing gun, the dispensing gun including a pawl-spring assembly and a hand-housing assembly coupled to the pawl-spring assembly and having a handle, a plunger assembly extending through the hand-housing assembly and including a push rod with a first end and a second end, and a push rod head removably coupled to the first end of the push rod, the push rod having a plurality of first notches and a plurality of second notches and a smooth section formed thereon, the push rod selectively cooperating with the pawl-spring assembly to advance the push rod and the push rod head during a dispensing operation, a retractor handle disposed at the second end of the push rod, the retractor handle extending from the push rod at an angle transverse with a longitudinal axis of the push rod, the retractor handle having a free end, and a secondary push rod head removably coupled to the free end of the retractor handle, and interchangeable with the push rod head;

extending the plunger assembly through the hand-housing assembly;

selecting a cradle configured to receive the vessel;

coupling the cradle to the hand-housing assembly;

positioning the vessel within the cradle, the vessel having a moveable piston bottom;

rotating the push rod to position one of the plurality of first notches, the plurality of second notches, and the smooth section in communication with the pawl-spring assembly; and advancing the push rod to engage the push rod head with the moveable piston bottom of the vessel and to dispense a desired dosage of the material from the vessel.

17. The method of claim 16, further comprising the step of interchanging the push rod head with the secondary push rod head.

18. The method of claim 16, further comprising the step of rotating the push rod to the smooth section to retract the push rod from the vessel.

* * * * *